US006532605B1

(12) United States Patent
Howell

(10) Patent No.: US 6,532,605 B1
(45) Date of Patent: Mar. 18, 2003

(54) DISPOSABLE POTTY/BED PAN LINER

(76) Inventor: Sherry Howell, 4 Barbie Ct., Baltimore, MD (US) 21220

( * ) Notice: Subject to any disclaimer, the term of this patent is extended or adjusted under 35 U.S.C. 154(b) by 0 days.

(21) Appl. No.: 10/059,353

(22) Filed: Jan. 31, 2002

Related U.S. Application Data

(60) Provisional application No. 60/330,094, filed on Oct. 19, 2001.

(51) Int. Cl.[7] ..... A47K 11/06

(52) U.S. Cl. ..... 4/484; 4/452; 383/11; 383/77

(58) Field of Search ..... 4/452, 484; 383/11, 383/77

(56) References Cited

U.S. PATENT DOCUMENTS

| | | | | | |
|---|---|---|---|---|---|
| 2,315,390 | A | * | 3/1943 | Billeb | 4/484 |
| 3,381,315 | A | * | 5/1968 | Glassberg | 4/484 |
| 3,495,278 | A | | 2/1970 | Peters | 4/484 |
| 3,936,890 | A | | 2/1976 | Oberstein | 4/484 X |
| 4,011,606 | A | | 3/1977 | Scrafield et al. | 4/457 |
| 4,343,053 | A | | 8/1982 | O'Connor | 4/452 |
| 4,759,086 | A | | 7/1988 | Booth-Cox | 4/452 |
| 4,882,794 | A | | 11/1989 | Stewart, III | 4/452 X |
| 4,996,727 | A | * | 3/1991 | Wyatt | 4/484 |
| 5,040,249 | A | * | 8/1991 | Diaz | 4/484 |
| 5,187,819 | A | * | 2/1993 | Grimes | 4/484 X |
| D354,342 | S | | 1/1995 | Marshall-Smith | 4/452 X |
| D402,739 | S | | 12/1998 | McClements | 4/452 X |
| 6,115,855 | A | | 9/2000 | Lorenzo | 4/484 |

FOREIGN PATENT DOCUMENTS

| | | | | |
|---|---|---|---|---|
| GB | 2224522 | * | 5/1990 | 4/452 |
| GB | 2248180 | * | 4/1992 | 4/484 |

* cited by examiner

*Primary Examiner*—Robert M. Fetsuga
(74) *Attorney, Agent, or Firm*—Richard C. Litman

(57) ABSTRACT

The present invention is a liner which may readily be utilized in a toilet receptacle such as a child's potty or a bedpan. The liner comprises a flexible sheet fabricated from biodegradable material. The sheet is liquid impermeable and capable of retaining human excrement. The central portion of the flexible sheet is adapted to assume a bag-like configuration so as to conform with the inner receptacle surfaces of a standard potty chair or bedpan. Unique attachment tabs are disposed on the perimeter of the sheet so that the liner may be adhesively secured in an efficient manner to the surfaces of the potty seat or bedpan. The design and arrangement of the attachment tabs are such that the tabs may be utilized to adhesively seal the liner after use whereby the sealed bag may be disposed of in a proper manner.

6 Claims, 7 Drawing Sheets

DISPOSABLE POTTY/BED PAN LINER

CROSS-REFERENCE TO RELATED APPLICATION

This application claims the benefit of U.S. Provisional Patent Application Serial No. 60/330,094, filed Oct. 19, 2001.

BACKGROUND OF THE INVENTION

1. Field of the Invention

The present invention generally relates to waste containment devices. More specifically, the present invention is drawn to a disposable liner for use with a potty or bed pan.

2. Description of Related Art

Aside from changing diapers, the most odious task in child rearing is that of emptying, cleaning and sterilizing the potty. The smell of the disinfectant cleaner makes this an unenviable assignment.

A similar scenario occurs when it is necessary to care for a disabled adult (perhaps a family member) who requires the use of a bedpan. Handling excrement from adults greatly increases the chances of transmitting infectious bacteria, especially in home environments and other situations where bedpan sterilization equipment may not be available or adequate. Providing a disposable, effective, easy-to-seal liner for potty or bedpan use, which liner is disposable-glove friendly, would certainly be a welcome addition to the art.

The prior art is replete with liners adapted for use with potties. For example, U.S. Pat. No. Des. 354,342 (Marshall-Smith) and U.S. Pat. No. Des. 402,739 (McClements) show designs for disposable potty liners. The patents do not discuss attachment structure for the liners.

U.S. Pat. No. 4,759,086 (Booth-Cox) shows structure wherein a receptacle is removably attached to the rim of a potty seat. The entire receptacle is removed for disposal.

U.S. Pat. No. 6,115,855 (Lorenzo) discloses a liner for a child's potty, wherein the liner is provided with a hole for insertion of a potty handle therethrough. The liner is relatively complicated to secure on the potty and could not be effectively used in a conventional bedpan.

U.S. Pat. No. 3,936,890 (Oberstein), U.S. Pat. No. 4,011,606 (Scrafield et al.) and U.S. Pat. No. 4,343,053 (O'Connor) show disposable bedpan liners. The attachment means of the instant liners would not be readily adaptable for potty seat use.

U.S. Pat. No. 4,882,794 (Stewart, III) shows a liner adapted for use for a bedpan or a potty seat. The liner has no means for sealing after use.

U.S. Pat. No. 3,495,278 (Peters) shows a bag toilet wherein the toilet seat is rotated to seal the bag after use.

None of the above inventions and patents, taken either singly or in combination, is seen to disclose a liner for use with a potty or a bedpan as will subsequently be described and claimed in the instant invention.

SUMMARY OF THE INVENTION

The present invention is drawn to a liner which may readily be utilized in a child's potty or a bedpan. The liner comprises a, flexible sheet fabricated from biodegradable material. The sheet is liquid impermeable and capable of retaining human excrement. The central portion of the flexible sheet is adapted to assume a bag configuration so as to conform with the inner receptacle surfaces of a standard potty chair or bedpan. Unique attachment tabs are disposed on the periphery of the sheet so that the liner may be adhesively secured and easily removed to the surfaces of the potty seat or bedpan in an efficient manner. The design and arrangement of the attachment tabs are such that the tabs may be utilized to adhesively seal the liner after use so that the sealed bag may be disposed of in a proper manner (trash, bio-hazard bin, incinerator, etc.).

As contemplated, the liner will be fabricated in two sizes (potty and bedpan). The liner may also be scented for deodorizing purposes if desired.

Accordingly, it is a principal object of the invention to provide a disposable liner for a bed pan or child's potty.

It is another object of the invention to provide a disposable liner for a bedpan or child's potty, which liner can be easily attached to the potty or bedpan.

It is a further object of the invention to provide a disposable liner for a bedpan or child's potty, which liner can be easily and efficiently sealed after use and which liner is, disposable-glove user friendly.

Still another object of the invention is to provide a disposable liner for a bedpan or child's potty, which liner is fabricated from biodegradable material.

It is an object of the invention to provide improved elements and arrangements thereof in a disposable liner for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
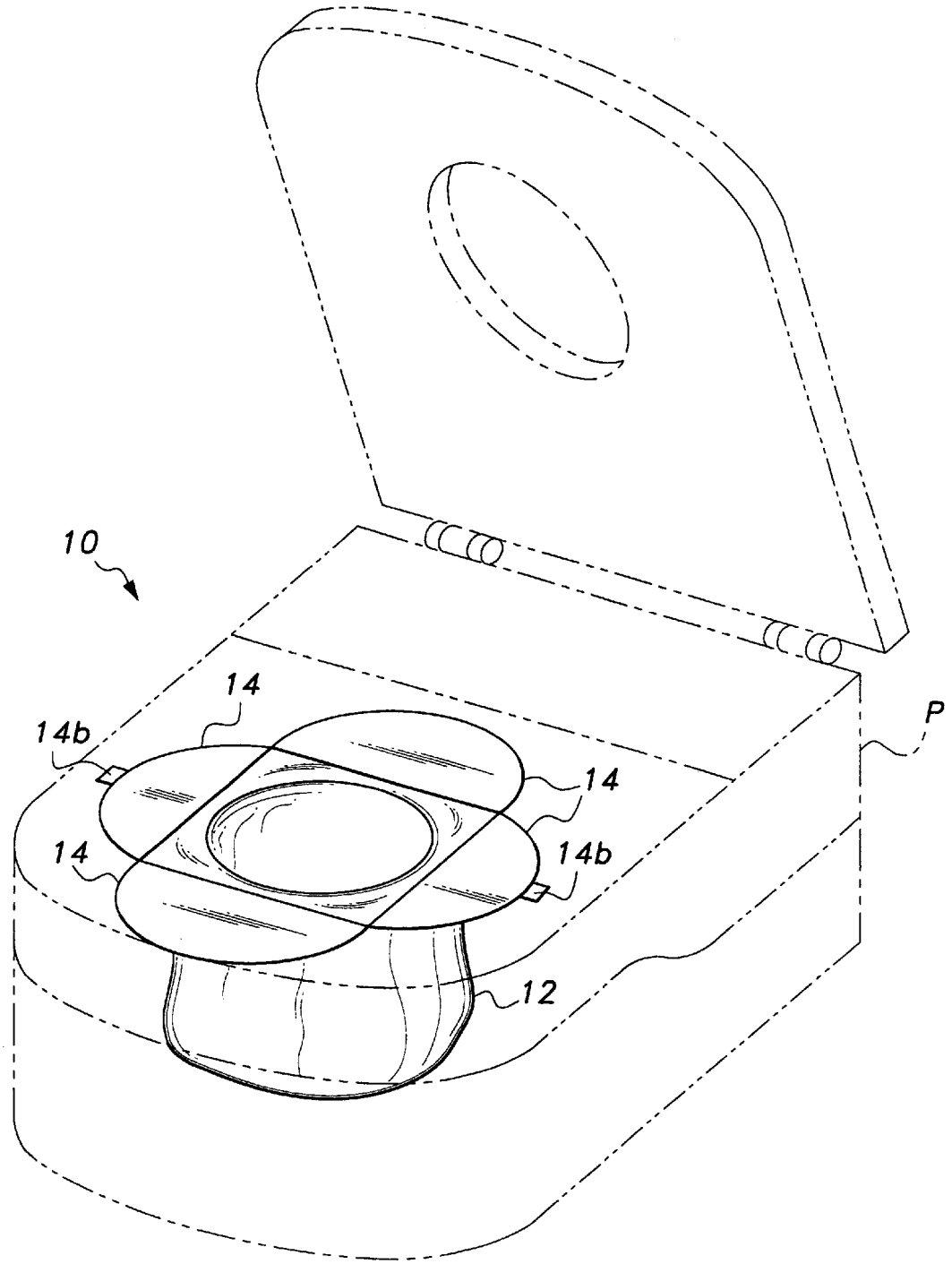
FIG. 1 is an environmental, perspective view of a disposable potty liner according to the present invention.
Figure 2:
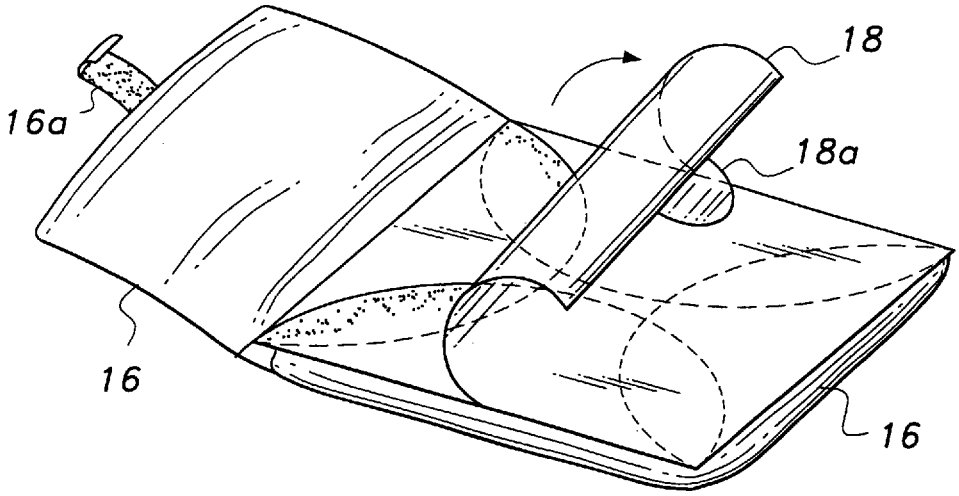
FIG. 2 is a perspective view of a potty liner in a before-use condition according to the present invention.
Figure 3:
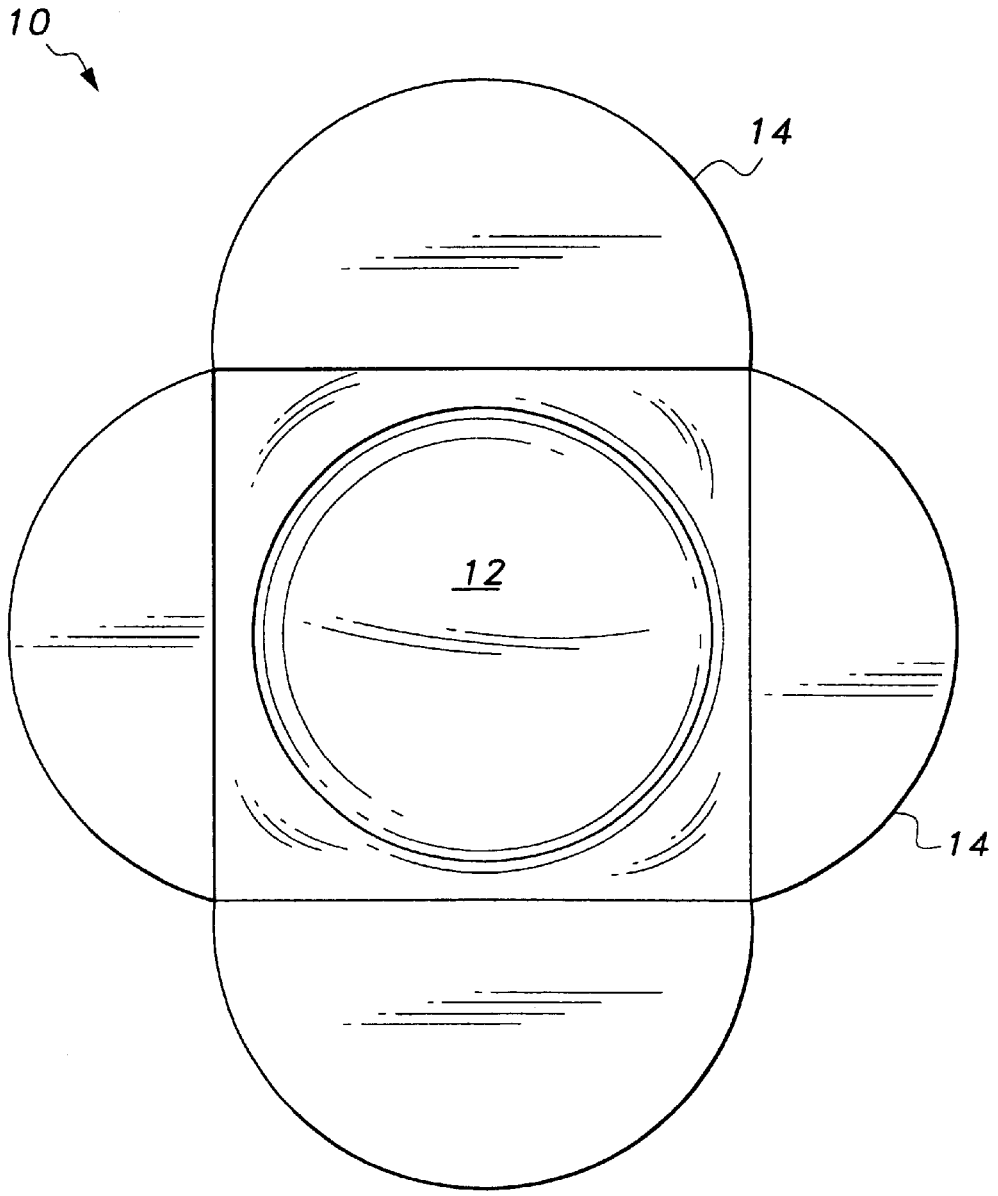
FIG. 3 is a plan view of a disposable potty liner according to the present invention.

Attention is first directed to FIGS. 1–3 of the drawings wherein the potty liner of the instant invention is generally indicated at 10. Liner 10 is fabricated from a thin, flexible, liquid impermeable, biodegradable material (paper or plastic). The material should be strong enough to hold human excrement without rupturing. Liner 10 includes a central portion 12 of bag-like configuration. Portion 12 is adapted to conform to the inner surfaces of the receptacle of a potty chair P (shown in phantom lines). Plural tab members 14 are positioned on the liner and evenly spaced therearound so as to contact and attach to the upper surface of potty chair. Adhesive is applied to the under surfaces of tab members 14 to achieve the attachment. Any suitable, commercially available, disposable-glove friendly adhesive may be applied to the liner. Conventional release liners (not shown) can be utilized to prevent adhesive exposure until use. Non-adhesive tabs 14*b* (shown only in FIG. 1) are attached to the peripheral edges of tabs 14 to enhance manipulation when wearing disposable gloves.

As contemplated, liner 10 may be individually wrapped and packaged for sale. As shown in FIG. 2, an individual liner is packaged in a wrapping 16, which wrapping is closed by an adhesive tab 16*a*, which tab is provided with a non-adhesive, fold-over end to enhance manipulation. A protective cover 18 having a pull tab 18*a* is positioned to overlie the liner.

Figure 4:
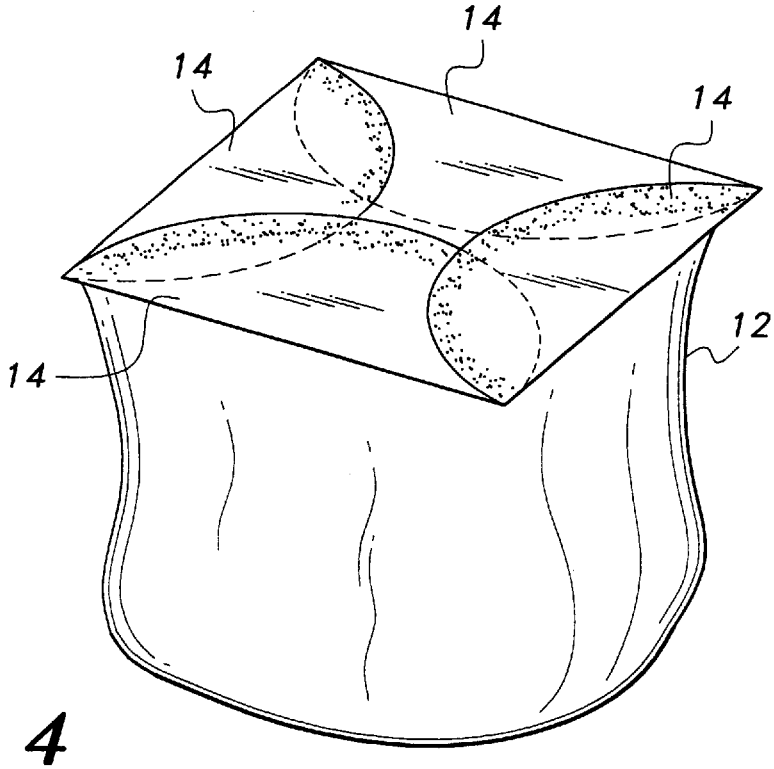
FIG. 4 is a perspective view of a potty liner in a sealed condition according to the present invention.

A decided advantage of the present invention is the utilization of the tab members 14, protective cover 18 and wrapping 16 to seal the liner for disposal. In a first embodiment (FIG. 4) after removal from the potty chair P, tabs 14 are simply folded over to close the liner bag 12. The adhesive on the underside of tabs 14 effectively seals the tabs in the closed position.

Figure 5:
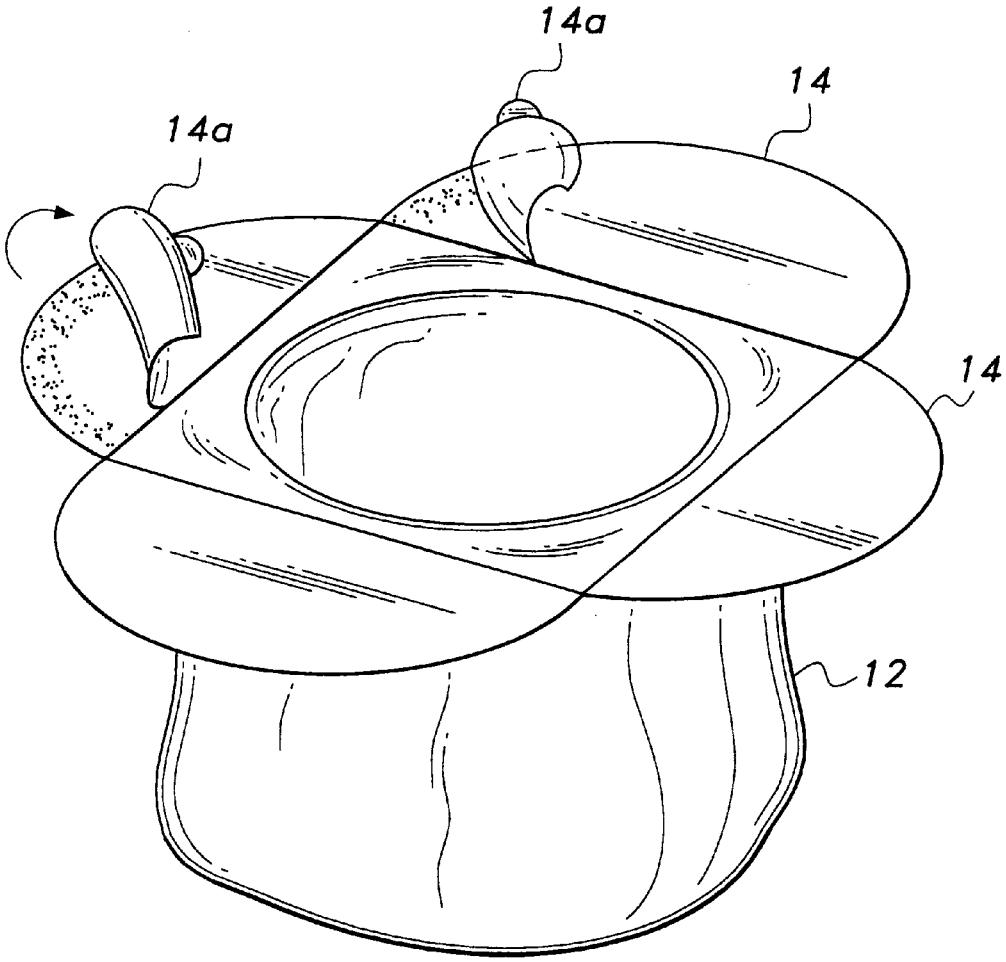
FIG. 5 is a perspective view of a potty liner which shows peel and stick adhesive applied to adjacent surfaces of the tabs according to the present invention.
Figure 6:
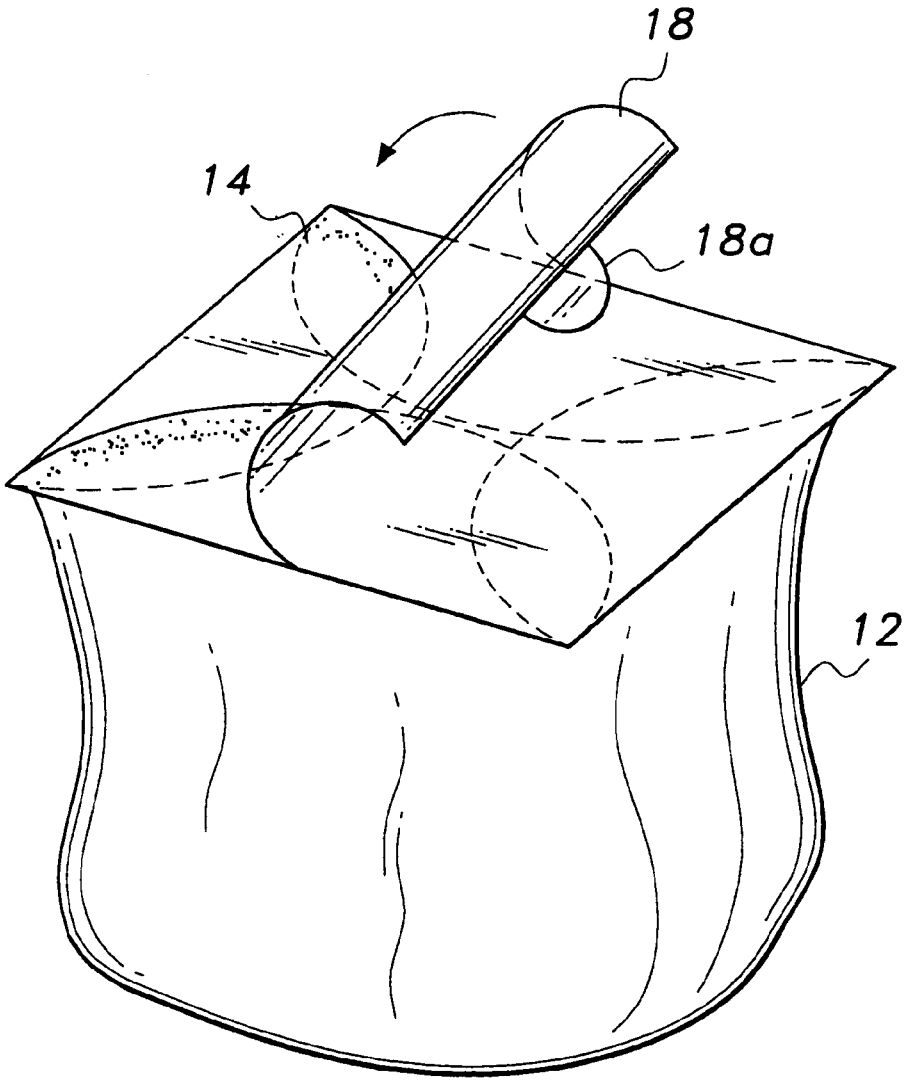
FIG. 6 is a perspective view of a potty liner which shows the reusable protective paper utilized to close and seal the liner is according to the present invention.

FIG. 5 is illustrative of a second embodiment wherein in addition to the underside, adhesive is applied to the topside of two adjacently positioned tabs 14. Release liners 14*a* are provided to prevent adhesive exposure until use. Having adhesive on both sides will allow a user to secure the tabs together to close and seal the wastes in the liner. Alternatively, as shown in FIG. 6, protective cover 18 can be reused and attached to the tabs to further seal the wastes in the liner.

Figure 7:
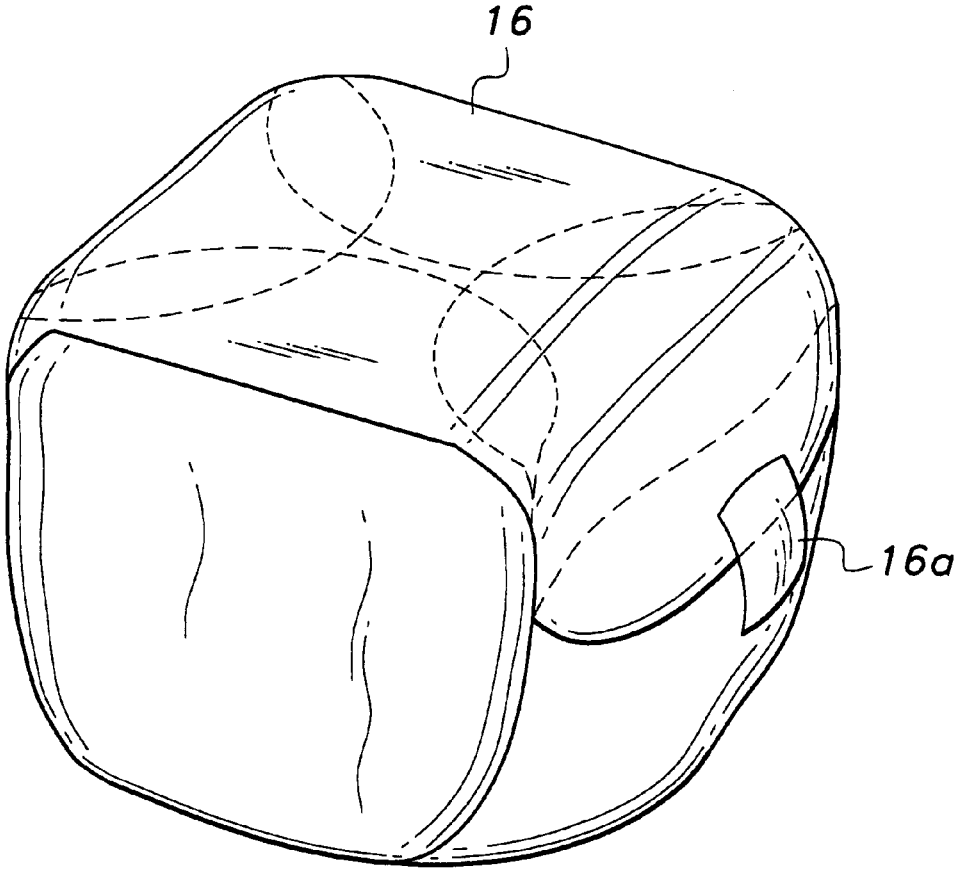
FIG. 7 is a perspective view of a potty liner which shows the liner wrapped with individual liner packing according to the present invention.

In FIG. 7 the liner is secured in wrapping 16. Adhesive tab 16*a* is reused to fasten the ends of wrapping 16.

Figure 8:
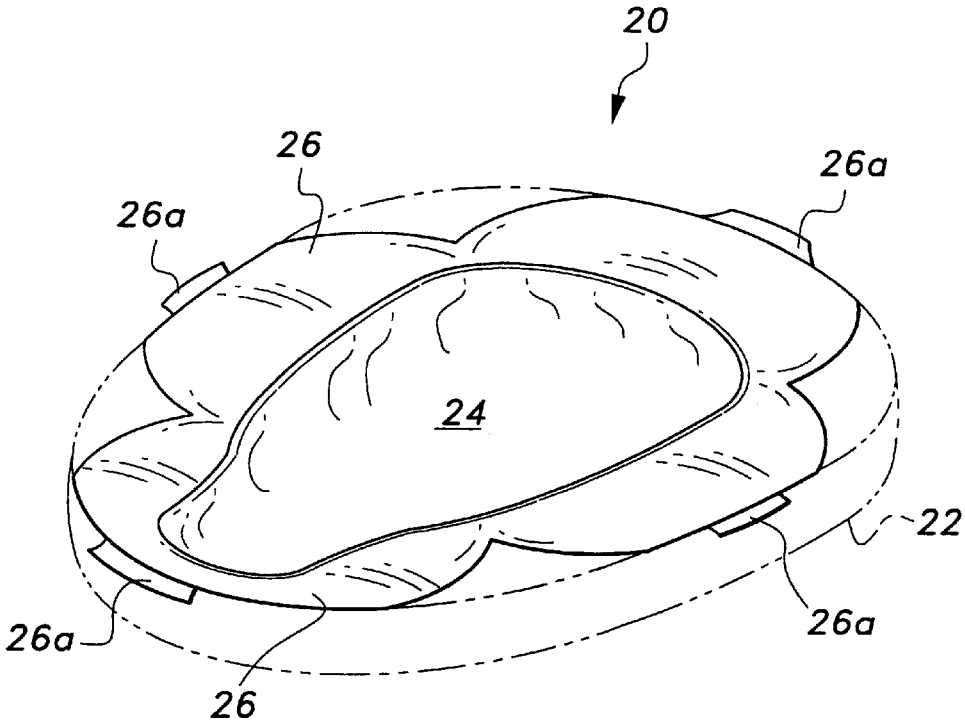
FIG. 8 is an environmental perspective view of a bed pan liner according to the present invention.
Figure 9:
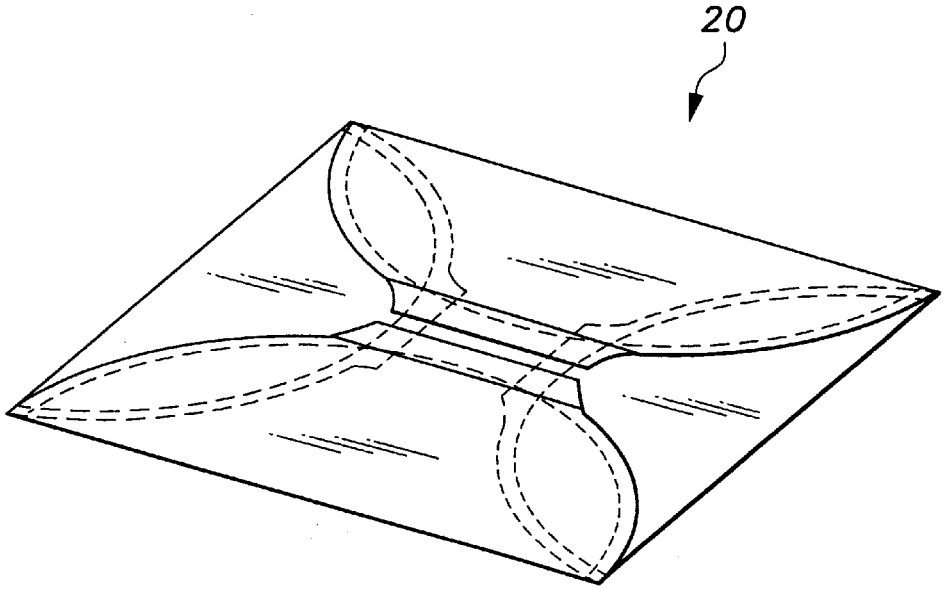
FIG. 9 is a perspective view of a bed pan liner shown in a before-use condition according to the present invention.

FIGS. 8 and 9 illustrate an embodiment wherein a disposable liner generally indicated at 20 is adapted to a conventional bed pan 22 (shown in phantom lines). As with the potty liner above, liner 20 is fabricated from a thin, flexible, liquid impermeable, biodegradable material (paper or plastic). The material should be strong enough to hold human excrement without rupturing. Liner 20 includes a central portion 24 of bag-like configuration. Portion 24 is adapted to conform to the inner surfaces of the bed pan 22. Four tabs 26, having adhesive under surfaces, are positioned around the liner and are adapted to be disposed on and adhere to the upper surfaces of bed pan 22. Like potty liner 10, liner 20 also has two adjacent tabs provided with adhesive on their upper surfaces. The edges of tabs 26 are provided with non-adhesive easy-grip pull tabs 26*a* so that the liner may be easily removed from the bed pan when using disposable gloves. FIG. 9 is illustrative of liner 20 in a before use condition. Bed pan liner 20 will be packaged and sealed after use in a manner similar to that of potty liner 10.

It is to be understood that the present invention is not limited to the sole embodiments described above, but encompasses any and all embodiments within the scope of the following claims.

I claim:

1. A liner for use with a toilet receptacle, said liner comprising:

a flexible, water-impermeable sheet having a central portion, said sheet fabricated from biodegradable material;

a bag-like member defined by said central portion;

four tab members formed on said central portion and spaced evenly therearound, each said four tab members having an under side, an upper side and a peripheral edge;

adhesive disposed on the under side of each of said four tab members;

non-adhesive pull tab members attached to said peripheral edge of at least two of said four tab members; and adhesive disposed on the upper side of two of said four tab members, wherein said two of said four tab members are adjacently positioned on said central portion.

2. A liner for use with a toilet receptacle as recited in claim 1, including a removable, protective release paper disposed to cover said adhesive on the upper side of said two of said four tab members.

3. A liner for use with a toilet receptacle as recited in claim 1, wherein said toilet receptacle is a child's potty.

4. A liner for use with a toilet receptacle as recited in claim 1, wherein said toilet receptacle is a bedpan.

5. A liner for use with a toilet receptacle, said liner comprising:

a flexible, water-impermeable sheet having a central portion, said sheet fabricated from biodegradable material;

a bag-like member defined by said central portion;

four tab members formed on said central portion and spaced evenly therearound, each said four tab members having an under side, an upper side and a peripheral edge;

adhesive disposed on the under side of each of said four tab members;

non-adhesive pull tab members attached to said peripheral edge of at least two of said four tab members;

adhesive disposed on the upper side of two of said four tab members, wherein said two of said four tab members are adjacently positioned on said central portion; and a protective cover sheet, said protective cover sheet adapted to close and secure said liner therein before and after use of said liner.

6. A liner for use with a toilet receptacle as recited in claim 5, wherein said protective cover sheet is fabricated from biodegradable material.

* * * * *